US005575009A

United States Patent [19]

Ryvin

[11] Patent Number: 5,575,009

[45] Date of Patent: Nov. 19, 1996

[54] COLD WEATHER FACE MASK AND HOOD

[75] Inventor: David Ryvin, Williamsville, N.Y.

[73] Assignee: American Allsafe Company, Tonawanda, N.Y.

[21] Appl. No.: 402,885

[22] Filed: Mar. 13, 1995

[51] Int. Cl.[6] ..... A42B 1/04

[52] U.S. Cl. ..... 2/173; 2/9; 2/202; 2/203; 2/206; 2/208; 2/209.13; 2/424

[58] Field of Search ..... 2/9, 171, 5, 173, 2/202, 203, 205, 206, 208, 209.13, 410, 423, 424; 128/201.13, 201.22, 201.25, 207.11

[56] References Cited

U.S. PATENT DOCUMENTS

| | | | |
|---|---|---|---|
| 1,235,927 | 8/1917 | Sanborn . | |
| 3,333,585 | 8/1967 | Barghini et al. | 128/201.13 |
| 3,531,952 | 10/1970 | Chesebro, Jr. | 66/171 |
| 3,594,814 | 7/1971 | Schuessler | 2/3 |
| 3,717,882 | 2/1973 | Schuessler | 2/173 |
| 3,768,100 | 10/1973 | Colman et al. | 2/9 |
| 3,968,521 | 7/1976 | Bashlow | 2/203 |
| 4,180,868 | 1/1980 | Snow | 2/203 |
| 4,272,853 | 6/1981 | Schuessler | 2/424 |
| 4,300,240 | 11/1981 | Edwards | 2/206 |
| 4,329,742 | 5/1982 | Schuessler | 2/424 |
| 4,641,379 | 2/1987 | Martin | 2/9 |
| 4,768,235 | 9/1988 | Webster | 2/205 |
| 4,823,407 | 4/1989 | Phillips, Jr. | 2/202 |
| 4,825,474 | 5/1989 | Edwards | 2/206 |
| 4,941,211 | 7/1990 | Blutstein | 2/202 |
| 5,035,006 | 7/1991 | Hetz et al. | 2/209.1 |
| 5,062,163 | 11/1991 | Avey | 2/424 |
| 5,214,804 | 6/1993 | Carey et al. | 2/206 |
| 5,251,336 | 10/1993 | Nevins | 2/202 |
| 5,431,156 | 7/1995 | Sundström | 128/201.25 |

*Primary Examiner*—Diana Biefeld
*Attorney, Agent, or Firm*—Dennis T. Griggs

[57] ABSTRACT

A cold weather face mask and hood combination is characterized by an elastic support strap which is releasably secured to at least one side of the mask and is trained through a retainer loop on the back of the hood so that the fit of the mask on the wearer's face may be adjusted to increase or decrease the snugness and to accommodate a range of sizes and shapes of facial features in the nose, mouth and chin area. The retainer loop holds the support strap in a selected position along the back of the hood to prevent the loop from slipping to the wearer's shoulders. The face mask has a nose-to-chin protecting pocket with a somewhat parabolic curvature to accommodate a range of sizes and shapes of facial features.

13 Claims, 5 Drawing Sheets

COLD WEATHER FACE MASK AND HOOD

FIELD OF THE INVENTION

The present invention is related generally to a face mask and hood advantageously worn in combination by a person exposed to cold weather conditions.

BACKGROUND OF THE INVENTION

Many occupations and activities require long term exposure to cold weather conditions making necessary or highly desirable the provision of headgear which may be snugly fitted to the wearer's head and face and providing insulation from exposure to extreme cold. Even short term exposure in severe cold weather conditions makes necessary the use of snugly fitted headgear and face mask combinations to prevent discomfort and frostbite.

However, while certain portions of headgear, such as a hood, may be easily provided in various sizes or of a fabric which will conform to various head sizes and shapes, the provision of a face mask which is comfortable to the wearer, provides adequate protection across the nose, mouth, chin and cheeks, and may be easily removed at least momentarily, for example, to provide for speaking, eating or drinking, has continued to be a problem in the manufacture and use of cold weather protective headgear. Accordingly, there is a continuing interest in providing a face mask which, in combination with a hood, in particular, may be easily adjusted to different face shapes and sizes for comfort by the wearer regardless of who he or she may be, is easily placed across the face and fastened for unattended wear, or momentarily removed therefrom without requiring further handling of the face mask and is of a configuration which is capable of being fitted to the face of a wide range of wearers. It is to these ends that the present invention has been developed.

DESCRIPTION OF THE PRIOR ART

Cold weather face masks and face mask/hood combinations have been developed wherein the mask or closure over the nose and mouth may be momentarily removed from its working position to permit speaking, eating or drinking, for example, without removing the entire face mask assembly. However, such prior art face mask and removable mouth covering combinations have not provided for adjustment of the nose and mouth covering portion of the face mask itself to accommodate different nose, cheek and chin size combinations or shapes.

Face mask and face mask/hood combinations have also been developed which advantageously utilize hook-and-loop or hook-and-pile-type fasteners which provide for ease of connection and disconnection of the mask support straps, for example. Again, known types of face masks and face mask/hood combinations do not provide for removal of the face mask from covering the nose and mouth region while leaving the face mask portion connected to the hood or other portion of the wearer's headgear so that the mask portion may be easily reconnected and also adjusted for maximum comfort and face covering.

Still further, conventional face masks for cold weather use have not been adapted to provide the advantageous features of position adjustment on the wearer to accommodate a range of facial sizes and features, quick release and reconnection.

SUMMARY OF THE INVENTION

The present invention provides an improved face mask or mouthpiece and hood combination for use by persons exposed to extreme low temperature or cold weather conditions.

In accordance with one important aspect of the present invention, a face mask or mouth, nose and chin cover and hood combination is provided which is formed of a suitable water-resistant and insulative fabric and which is further characterized by means which permit adjustment of the mask or cover on the wearer's face to accommodate different face sizes and shapes and to provide maximum comfort to the wearer. In particular, the face mask is provided with an elastic strap for securing the mask to the hood. The elastic strap is routed through a hook fastener strap stitched to the back of the hood in the principal embodiment, and is looped loosely about the neck of the hood in an alternative embodiment. Tension in the elastic strap may be adjusted to provide a comfortable fit, according to the wearer's head size.

In accordance with yet another aspect of the invention, there is provided a combination of a cold weather hood and face mask wherein the face mask is coupled to the hood by an elastic support strap which is looped about the neck portion of the hood and the distal end of the support strap is adjustably secured to the mask by a suitable fastener, such as a hook-and-loop-type fastener. The mask may be quickly released, moved up or down, to allow the wearer to speak, eat, drink, or perform other actions requiring exposure of the mouth and nose area. The face mask may be quickly restored to its protective position by merely pulling it down from the wearer's forehead or pulling it up from below the wearer's chin.

In accordance with yet a further aspect of the present invention, a face mask is provided with a concave pocket for receiving the wearer's nose, mouth and chin, as well as portions of the cheeks in a way which is more comfortable and the shape of the pocket is such that the face mask may be positioned to accommodate a wide range of facial features and sizes. In this regard, the concave pocket is formed to have a parabolic shape at least in substantially vertical profile. This parabolic shape, in combination with vertical retention of the face mask support strap with respect to the hood, provides a relatively close, conforming fit of the mask to many different facial sizes and shapes.

The combination hood and face mask of the invention is easily fabricated of conventional weatherproof and insulative fabrics and advantageously utilizes fastenings between the mask and hood and for the mask itself which are conventional and commercially available.

Those skilled in the art will recognize the above-described advantages and features of the invention, together with other superior aspects thereof upon reading the detailed description which follows in conjunction with the drawings.

DETAILED DESCRIPTION OF THE PREFERRED EMBODIMENT

Figure 1:
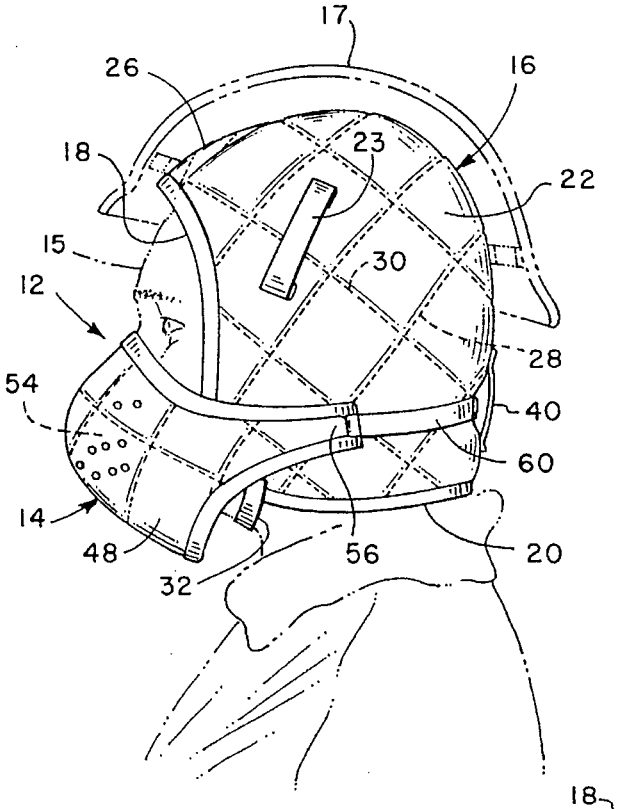
FIG. 1 is a left side elevation view of the face mask and hood combination of the present invention shown in position on a wearer's face and head.

The drawing figures may not necessarily be to scale in order to show certain features of the invention with clarity and conciseness.

Figure 2:
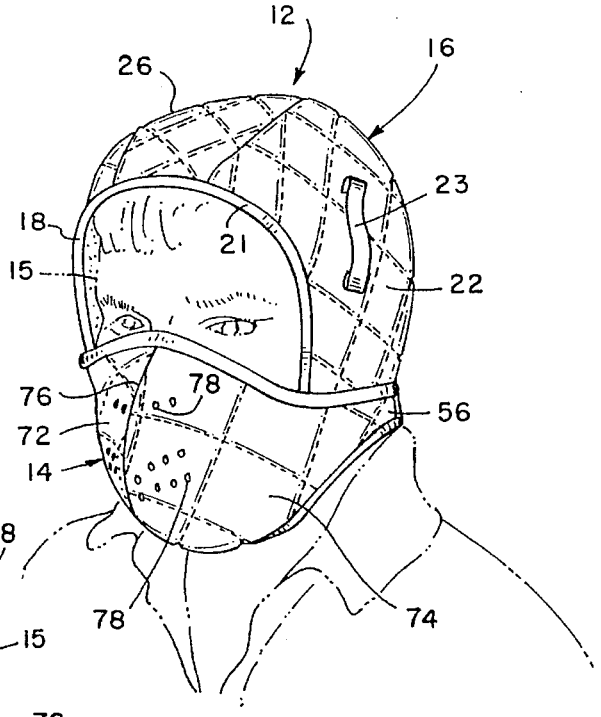
FIG. 2 is a left front perspective view of the face mask and hood on the wearer.
Figure 3:
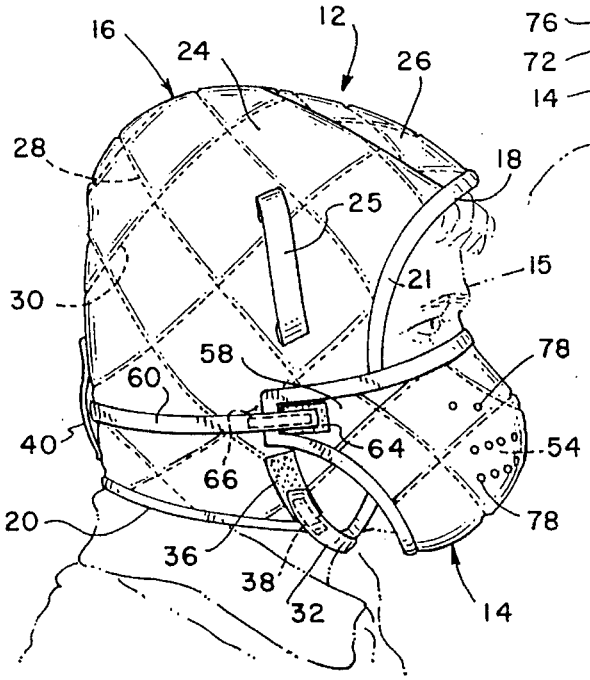
FIG. 3 is a right side elevation view of the face mask and hood on the wearer.

Referring to FIGS. 1, 2 and 3, there is illustrated a unique cold weather face mask and hood combination in accordance with the invention and generally designated by the numeral 12. The face mask and hood combination 12 includes a unique face mask, generally designated by the numeral 14, which is configured to cover the nose, mouth and chin of a person 15 and, as shown in FIGS. 1–3, the mask is configured to cover a substantial portion of the face below the eyes, including both cheeks. A snugly fitting hood 16 is provided as part of the combination face mask and hood 12 and is of a type which is contoured to fit rather closely around the head of the person 15, covering both ears and both sides of the face and delimited by a front peripheral edge 18. The hood 16 also covers the head down to at least adjacent to or slightly below the collar as delimited by a lower edge 20.

Figure 5:
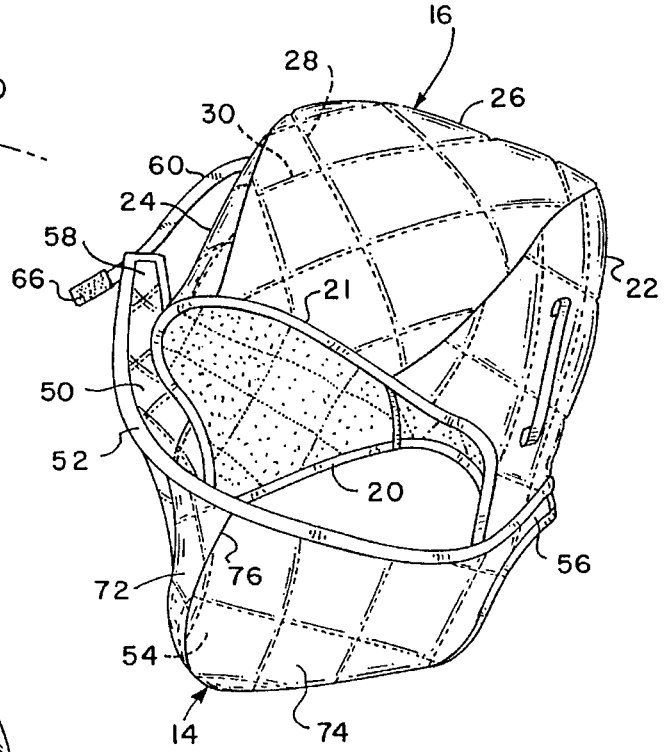
FIG. 5 is a front perspective view of the face mask and hood detached from a wearer.
Figure 6:
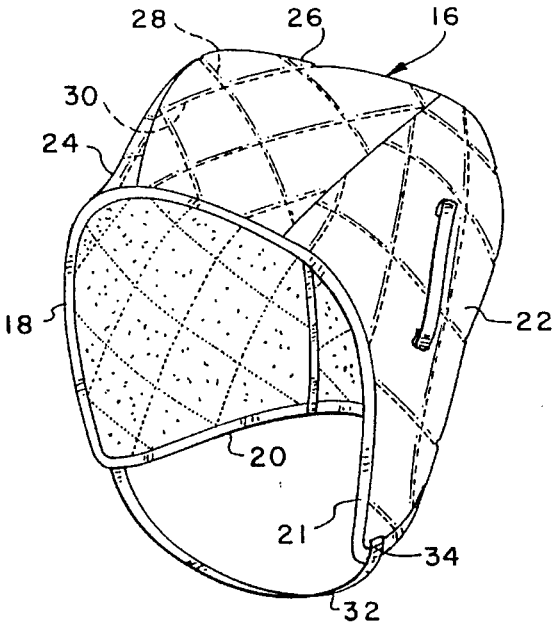
FIG. 6 is a left front perspective view of the hood alone.
Figure 7:
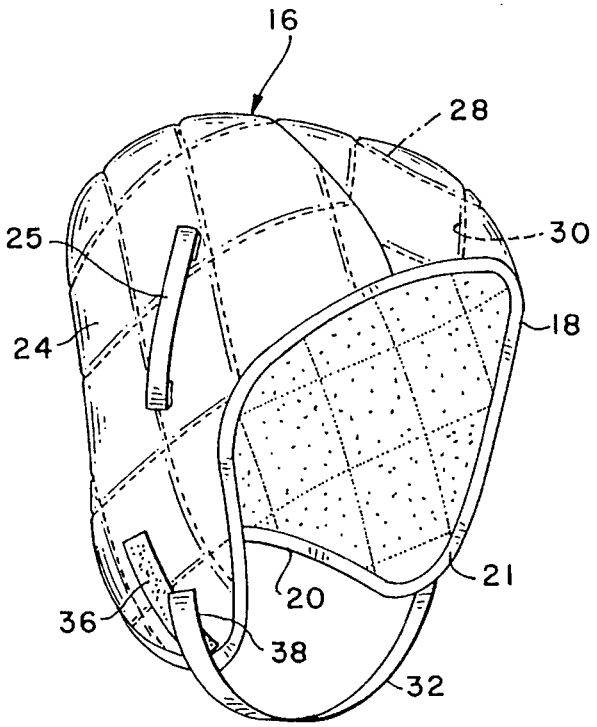
FIG. 7 is a right front perspective view of the hood alone.

Referring briefly to FIGS. 5 and 6, the hood 16 is preferably formed of three separate panels or parts comprising a left side part 22, a right side part 24 and a centerpart 26. The hood parts 22, 24 and 26 are suitably sewn together using conventional techniques. The hood 16 is preferably formed of a water repellant outer layer of fabric, such as woven or knit nylon, and an inner layer of knit cotton or acrylic, for example, with a layer of suitable insulation interposed therebetween. The front and bottom edges 18 and 20 are finished with a fabric border strip 21 sewn to the parts 22, 24, 26. The form and shape of the fabric parts and insulation making up the hood 16 is enhanced by stitching a quilt-like pattern along intersecting stitch lines 28, 30, for example. As shown in FIGS. 1, 3 and 6, the hood 16 includes a chin strap 32 suitably sewn to the lower front edge of the part 22, as indicated at 34 in FIG. 6.

Figure 11:
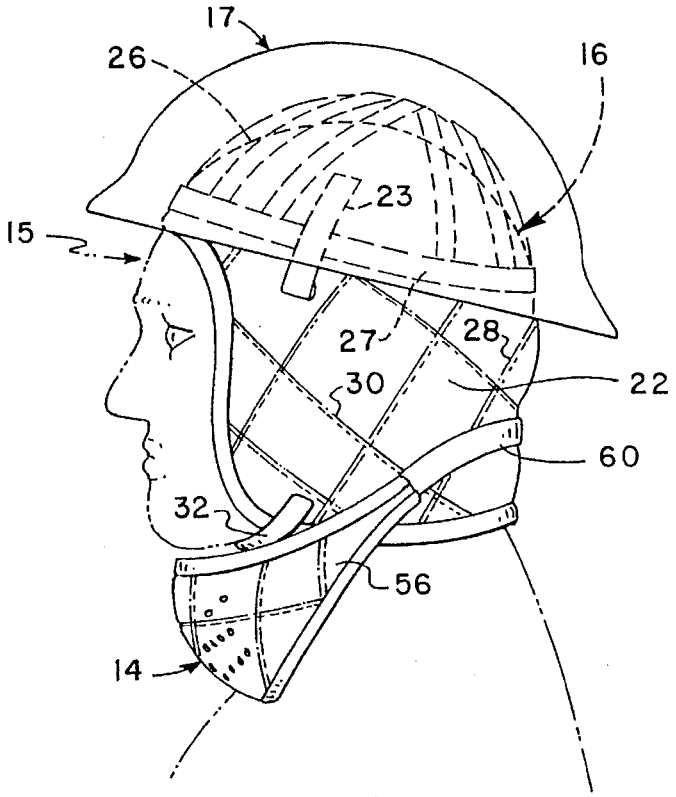
FIG. 11 is a side elevational view of an alternative embodiment in which the hook fastener strap has been removed and the face mask is pulled below the wearer's chin; and, FIG. 12 is a rear elevational view of the alternative embodiment showing the typical resting position of the elastic support strap when the face mask is pulled below the wearer's chin.
Figure 12:
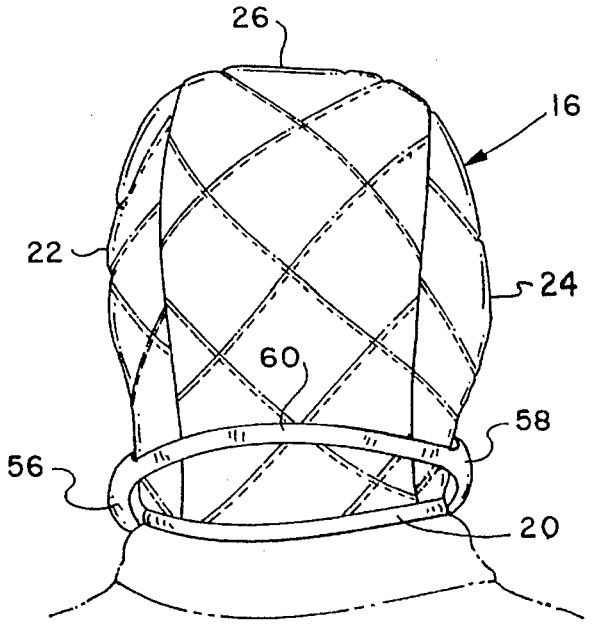

The chin strap 32 may be formed of durable flame retardant elastic fabric and is preferably secured to the opposite hood part 24 by suitable fastening means comprising VELCRO® hook-and-loop fastening elements 36, 38, FIG. 3. One of the elements 36, 38 is secured to the hood part 24 and the other element to the distal end of the strap 32. The fastening elements 36, 38 are each made of sufficient length that suitable adjustment of the strap 32 may be obtained to accomodate the particular wearing person 15. As shown in FIG. 1, the hood 16 is of such configuration as to comprise a snugly fitting insulative covering for a substantial portion of the head of the wearer 15. The hood 16 is conveniently configured so that the wearer 15 may wear other headgear, such as a hard hat or helmet 17, FIG. 1. Safety helmet retention loops 23, 25, FIGS. 1 and 3, are also advantageously provided on the opposite sides of the hood 16. Referring to FIG. 11, a helmet retention strap 27 is routed through the loops 23, 25.

Figure 4:
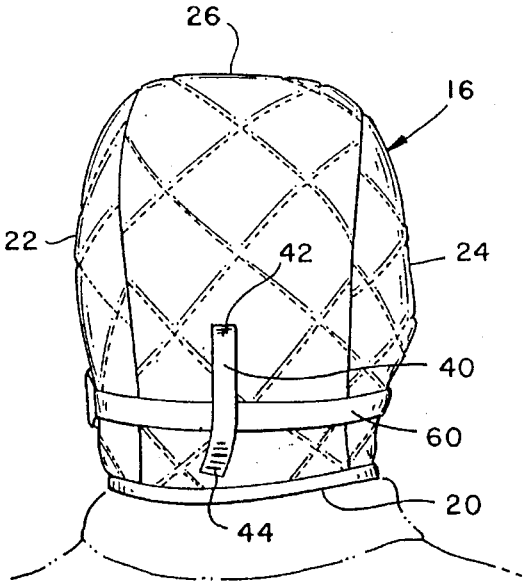
FIG. 4 is a back side elevation view of the face mask and hood showing retention of the elastic support strap by a hook fastener loop.
Figure 9:
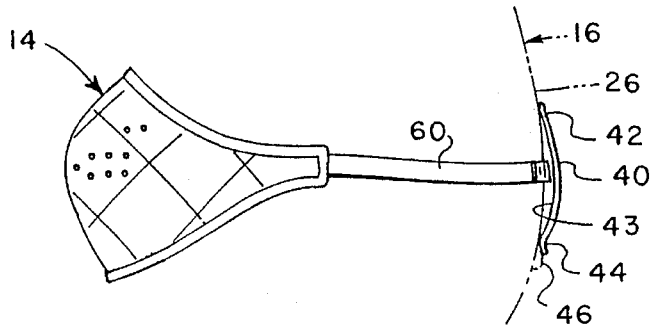
FIG. 9 is a detail view of the face mask showing the retention of the elastic support strap by the hook fastener strap.
Figure 10:
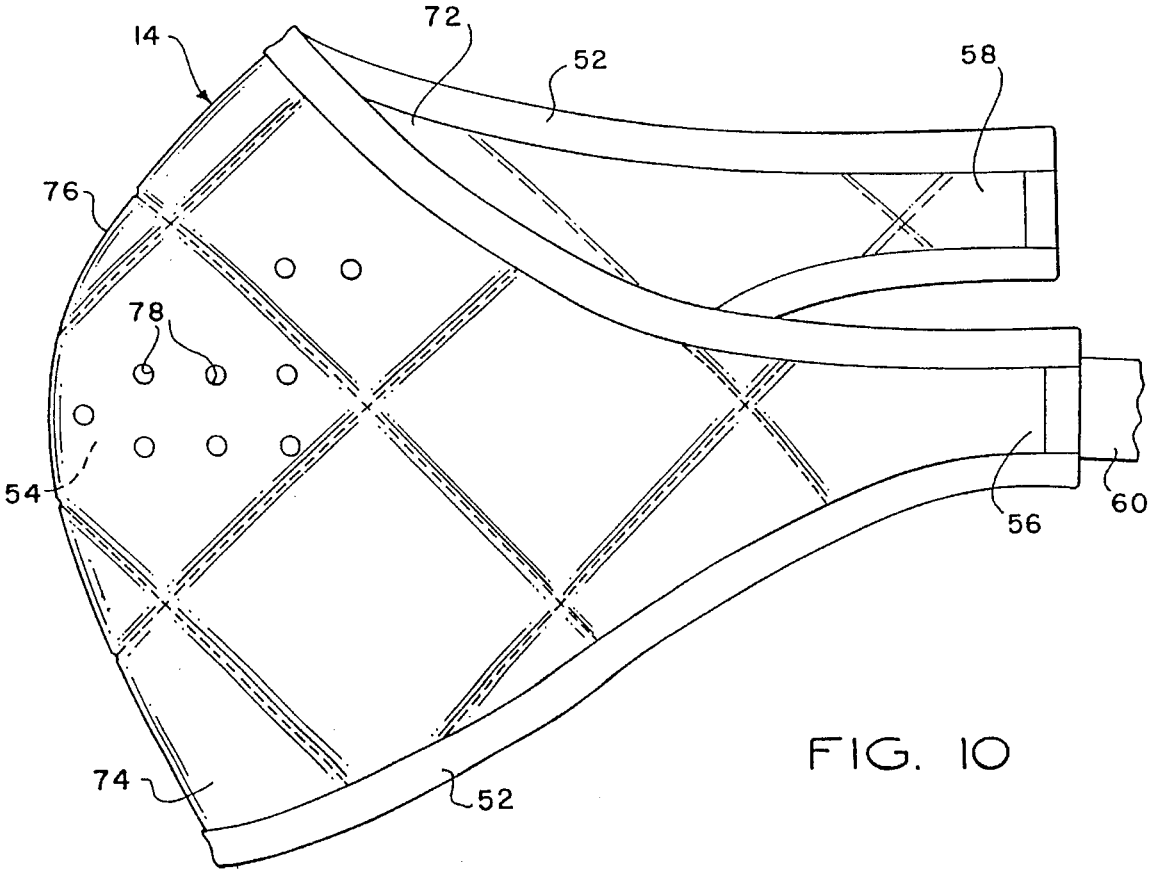
FIG. 10 is a perspective view of the face mask illustrating the unique curvature of the mask.

FIGS. 1, 4 and 9 show an important feature of the hood 16 which is characterized by a strap-like retainer element 40 secured to the back of the hood above the bottom edge 20 and substantially centrally, with respect to the opposite sides of the hood 16 on the centerpart 26. The retainer strap 40 is preferably permanently secured to the hood 16 at 42 and 44 by suitable stitching. Accordingly, the retainer strap 40 forms a generally vertically extending loop or hook on the hood 16 centrally along the rearward or backside of the hood and in a position generally opposite the mouth of the wearer 15.

Referring again to FIGS. 1–3, the face mask and hood combination 12 advantageously utilizes the unique face mask 14 which is preferably made of the same materials used to make the hood 16, that is an outer fabric layer 48, an inner fabric layer 50, FIG. 5, and a border 52. The fabric parts 48, 50 are sewn together using the quilt pattern stitching similar to that used for the hood 16. As shown in FIG. 5, the face mask 14 has a center pocket portion 54 and opposed side tab portions 56, 58 which, as shown in FIGS. 1 and 3, extend approximately half way around the respective sides of the head of the wearer 15.

A support strap 60 is suitably secured, such as by zig-zag stitching, to the distal end of the tab 56, FIG. 1, and is releasably securable to the tab 58 by cooperating hook-and-loop fastener elements 64, 66 (see FIGS. 3 and 5) sewn on the tab 58 and the distal end of the strap 60, respectively. The hook-and-loop fastener elements 64, 66 are of sufficient length to permit suitable adjustment of the effective length of strap 60 for comfort of the wearer 15 and positioning of the face mask 14 on the wearer's face. Moreover, the hook-and-loop-type fasteners 64, 66 also provide for quick release and reattachment of the face mask 14 when it is desired to do so.

An important advantage of the present invention is indicated somewhat schematically in FIG. 9. The tension of the elastic support strap 60 may require adjustment to accommodate the facial features and contours of the wearer 15 as well as with regard to the tightness of the fit of the face mask on the wearer's face. In this regard, the support strap 60 is trained or routed between the retainer strap 40 and the hood 16.

The elastic support strap 60 may be loosened or tightened to accommodate the size and shape of the facial features of the wearer 15, particularly the wearer's nose, chin and cheek size and spacing. Moreover, once the position of the face mask 14 has been adjusted within the loop or space formed by the strap 40 and hood 16 and "fitted" to the wearer's face, the face mask may be pulled up or down temporarily by the wearer to permit the wearer to speak, eat or drink and then restored to the initially fitted, protective position.

Figure 8:
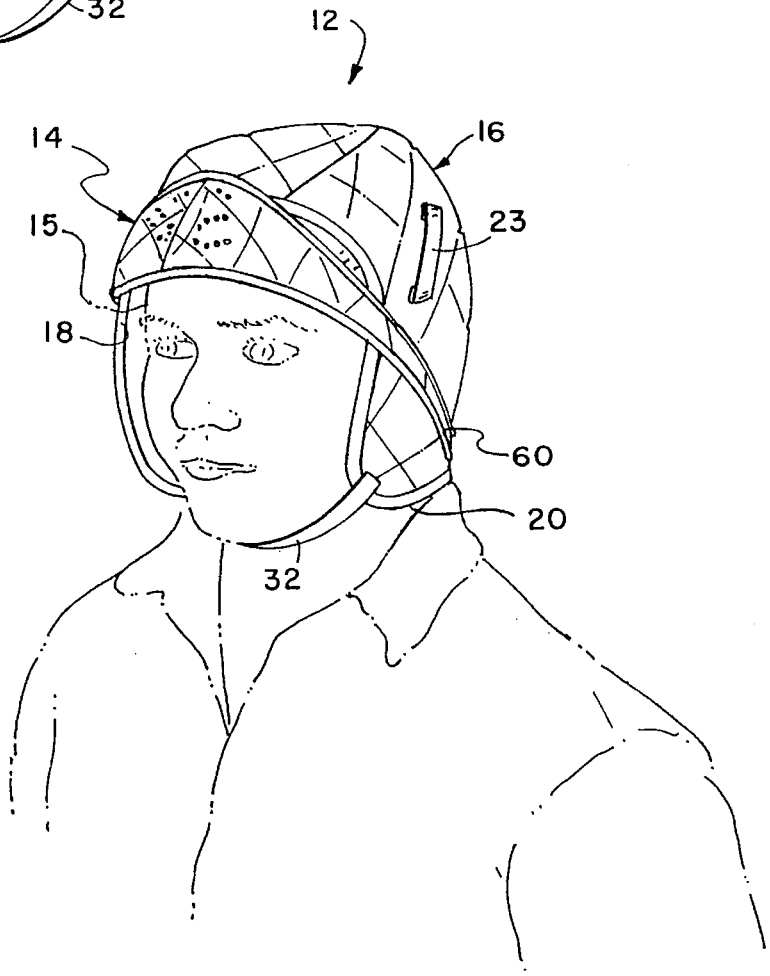
FIG. 8 is a view showing the hood and face mask on a wearer with the face mask covering the wearer's forehead.

FIG. 8 and FIG. 11 illustrate how the face mask 14 may be easily carried in a non-working position by the wearer 15 by being placed under the chin or over the brim of the safety helmet or over the forehead if no safety helmet is being worn. The face mask is temporarily positioned on the wearer's forehead (FIG. 8) or below the wearer's chin (FIG. 11). Since the elastic support strap 60 is looped about the wearer's neck, there is no tendency for the mask 14 to become detached from the hood 16. Moreover, the face mask 14 may be quickly and easily lifted from under the chin or pulled down from the forehead and restored to its protective position over the wearer's mouth.

Another important advantage of the present invention, provided by the face mask 14, relates to the curvature of the mask in a substantially vertical plane when the mask is being worn by a wearer 15, for example. As shown in FIGS. 2 and 5, the mask 14 is preferably made of two separate panels 72, 74 which are sewn together along a line 76, which lies in the vertical plane. The curvature of the parting or stitch line 76 is substantially parabolic in the aforementioned vertical plane, which curvature has been indicated to be superior to accommodate a wide range of shapes and sizes of facial features of respective wearers of the mask 14. Accordingly, the mask 14 has superior features which aid in its comfort to a variety of wearers wherein one mask size may be adjusted to fit several different sizes and shapes of wearers' faces and be merely adjusted by any given wearer to change mask position for greater comfort during long periods of use.

As shown in FIGS. 1–3 and FIG. 10, the face mask 14 is also preferably provided with a plurality of ports 78 formed in both panels 72, 74 to facilitate breathing action and ventilation through the face mask.

Fabrication of the face mask 14 and the hood 16, as well as use of the combination of the face mask and hood, are believed to be understandable to those of ordinary skill in the art from the foregoing description. Conventional fabrics used in cold weather headgear may be used for both the hood and the mask in addition to the particular fabrics mentioned. The hook-and-loop-type fasteners are particularly advantageous for fastening the face mask 14 to its support strap 60 and for adjusting the position of the support strap 60 with respect to the hood 16. Similar types of quick release and reusable fasteners may, of course, be used also in place of the hook-and-loop-type fasteners.

Although a preferred embodiment of the invention has been described in detail herein, those skilled in the art will recognize that various substitutions and modifications may be made to the mask and hood combination as well as the individual components without departing from the scope and spirit of the appended claims.

What is claimed is:

1. In combination, a cold weather hood and face mask for protection of the head and at least a portion of the face of a wearer of the hood and face mask, the hood being formed of a flexible insulative fabric and being shaped to at least partially enclose the head of a wearer and being delimited by a front peripheral edge to expose the face of a wearer, and the face mask being formed of a flexible insulative fabric and being shaped to closely conform to at least a portion of the face of a wearer, characterized in that:

the face mask includes means forming a pocket portion and two opposed side tab portions projecting from said face mask, a support strap secured at one end to one of the tab portions, the support strap having fastening means on a distal end thereof for attachment to fastening means on the other of the tab portions of said face mask for releaseably securing said face mask around the neck of a wearer, and the support strap including a resilient member which is stretchable to permit the face mask to be moved from a protective covering position over at least a portion of a wearer's face to a position either below the chin or over the forehead without moving said hood from a position protecting the head of a wearer.

2. The invention as set forth in claim 1, wherein:

said hood includes means attached to said hood for retaining the support strap whereby said support strap may be moved from a position covering a portion of the face of a wearer to an uncovered position to permit access to a wearer's mouth for speaking, eating or drinking, for example, without detaching the support strap from said hood.

3. The invention as set forth in claim 2, wherein:

said support strap retaining means includes fastening means on said hood cooperative with said support strap to secure said support strap to said hood.

4. The invention as set forth in claim 2, wherein:

said support strap retaining means comprises a retainer strap disposed on a back portion of said hood and engageable with said support strap to retain said support strap.

5. The invention as set forth in claim 4 wherein:

said support strap comprises an elastic material.

6. The invention as set forth in claim 4, wherein:

said retainer strap on said hood forms a loop for receiving said support strap whereby said support strap may be retained at a fixed location along the back of said hood while the face mask is in the face covering position and in an uncovered position, respectively.

7. The invention as set forth in claim 1, wherein:

said face mask is shaped to provide said pocket for covering the nose, mouth and chin of a wearer, said pocket having a predetermined curvature in a substantially vertical plane when said face mask is placed on a wearer's face to accommodate a range of sizes and shapes of facial features, including a nose and chin.

8. The invention as set forth in claim 1, wherein:

said face mask is formed of opposed fabric panels which are sewn together along a line defining a predetermined pocket curvature.

9. The invention as set forth in claim 8 wherein:

the predetermined pocket curvature is substantially parabolic.

10. A cold weather hood and face mask combination for protecting of the head and at least part of the face of a wearer of said hood and face mask, said hood and face mask being characterized by:

said face mask including means forming a pocket for receiving the nose-to-chin area of a wearer of said face mask, said pocket having a predetermined substantially parabolic curvature in a substantially vertical plane when said face mask is placed on a wearer's face to accommodate a range of sizes and shapes of facial features, said face mask including a support strap constructed for attachment to said face mask at opposite ends of said support strap; and said hood including means forming a generally vertically extending loop along a backside of said hood for receiving said support strap trained through said loop.

11. The invention as set forth in claim 10 wherein:

said face mask is formed of opposed fabric panels sewn together along a curved line defining said pocket.

12. The invention as set forth in claim 10 wherein:

said support strap has a distal end provided with fastening means cooperable with fastening means on said face mask for releasably securing said support strap distal end to said face mask.

13. A cold weather hood and face mask combination for protecting of the head and at least part of the face of a wearer of said hood and face mask, said hood and face mask being characterized by:

said hood being formed of a flexible insulative fabric and being shaped to closely conform to and protect the head of a wearer of said hood and face mask and being delimited by a front peripheral edge to expose at least a portion of the face of a wearer of said hood and face mask, said hood having opposed sides and a center portion covering the head and being delimited by a lower peripheral edge, said hood including a retainer strap secured to an outer surface of a back portion of said center portion above said lower edge, said retainer strap forming a generally vertically extending loop on said hood in a position generally opposite the mouth of a wearer; and said face mask including means forming a pocket portion and two opposed side tab portions projecting from said face mask and a support strap secured at one end to one of the tab portions and having fastening means on a distal end of said support strap for attachment to fastening means on the other of the tab portions of said face mask for releasably securing the face mask to cover at least a portion of the face of a wearer and said support strap being trained through said loop formed by said retainer strap for retaining said face mask attached to said hood while permitting said face mask to be moved from a protective covering position over at least a portion of a wearer's face to a position either below the chin or over the forehead of a wearer's face without moving said hood from a position protecting the head of a wearer.

* * * * *